US009893425B2

(12) United States Patent
Liou et al.

(10) Patent No.: US 9,893,425 B2
(45) Date of Patent: Feb. 13, 2018

(54) ANTENNA STRUCTURE AND WIRELESS COMMUNICATION DEVICE USING THE SAME

(71) Applicant: Chiun Mai Communication Systems, Inc., New Taipei (TW)

(72) Inventors: Geng-Hong Liou, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 461 days.

(21) Appl. No.: 14/523,379

(22) Filed: Oct. 24, 2014

(65) Prior Publication Data

US 2015/0180131 A1 Jun. 25, 2015

(30) Foreign Application Priority Data

Dec. 23, 2013 (CN) ..... 2013 1 0715661

(51) Int. Cl.
*H01Q 9/04* (2006.01)

(52) U.S. Cl.
CPC ..... *H01Q 9/0414* (2013.01); *H01Q 9/045* (2013.01)

(58) Field of Classification Search
CPC ..... H01Q 9/0414; H01Q 9/045
USPC ..... 343/700 MS
See application file for complete search history.

(56) References Cited

U.S. PATENT DOCUMENTS

2011/0260925 A1* 10/2011 Chirila ..... H01Q 1/38 343/700 MS
2012/0105291 A1 5/2012 Tu
2012/0154222 A1* 6/2012 Oh ..... H01Q 1/243 343/702
2012/0169568 A1* 7/2012 Oh ..... H01Q 1/243 343/893

FOREIGN PATENT DOCUMENTS

TW M395272 U1 12/2010

* cited by examiner

*Primary Examiner* — Dameon E Levi
*Assistant Examiner* — David Lotter
(74) *Attorney, Agent, or Firm* — ScienBiziP, P.C.

(57) ABSTRACT

An antenna structure includes a baseplate, a first radiator plate, a second radiator plate, and a third radiator plate. The baseplate has a first surface and a second surface opposite to the first surface. The first radiator plate is disposed on the first surface. The second radiator plate is disposed on the first surface. The third radiator plate is disposed on the second surface. A slot is defined between the first radiator plate and the second radiator plate, and the second radiator plate is coupled to the first radiator plate and the third radiator plate.

15 Claims, 5 Drawing Sheets

ANTENNA STRUCTURE AND WIRELESS COMMUNICATION DEVICE USING THE SAME

FIELD

The disclosure generally relates to antenna structures, and particularly to a multiband antenna structure, and a wireless communication device using the same.

BACKGROUND

Antennas are used in wireless communication devices such as mobile phones. The wireless communication device uses a multiband antenna to receive/transmit wireless signals at different frequencies, such as wireless signals operated in a long term evolution (LTE) band.

BRIEF DESCRIPTION OF THE DRAWINGS

Implementations of the present technology will now be described, by way of example only, with reference to the attached figures.

DETAILED DESCRIPTION

Figure 1:
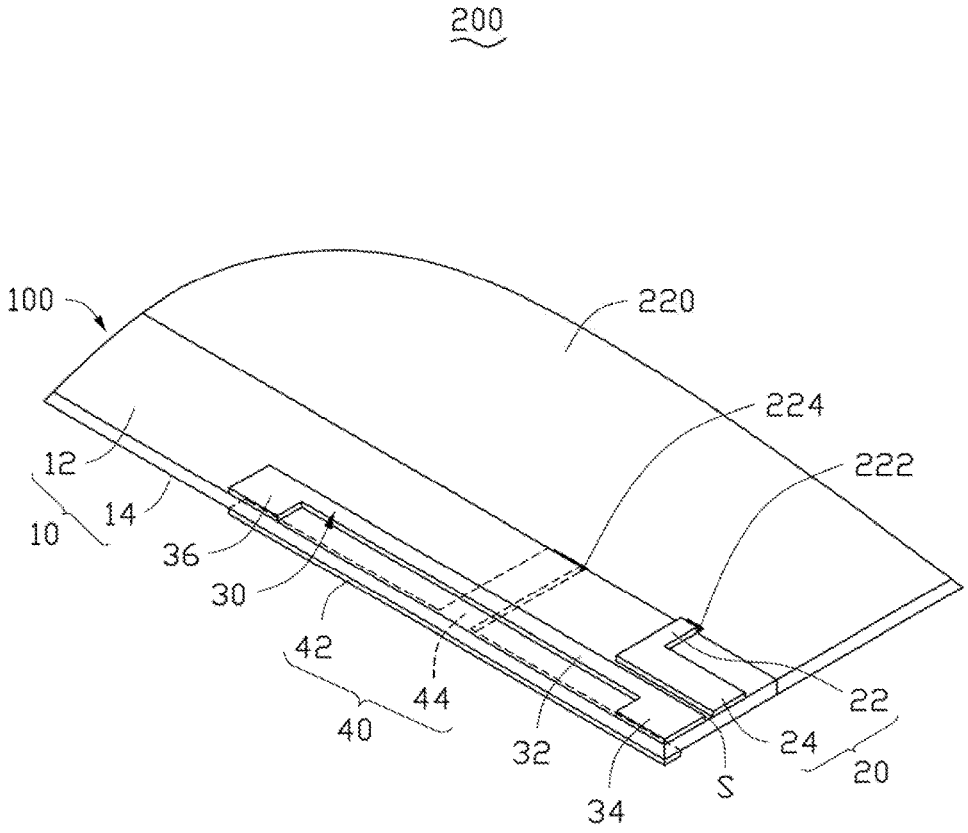
FIG. 1 is an isometric view of a wireless communication device employing an antenna structure, according to an exemplary embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to an antenna structure and a wireless communication device using same.

FIG. 1 illustrates an embodiment of a wireless communication device 200 employing an antenna structure 100, according to an exemplary embodiment. The wireless communication device 200 can be a mobile phone, a tablet, or an intelligent watch, for example (details not shown). The wireless communication device 200 further includes a printed circuit board (PCB) 220, the PCB 220 forms a feed pin 222 and a ground pin 224. The antenna structure 100 receives current from the feed pin 222, and is grounded by the ground pin 224.

The antenna structure 100 includes a baseplate 10, a first radiator plate 20, a second radiator plate 30, and a third radiator plate 40. The baseplate 10 carries the first radiator plate 20, the second radiator plate 30, and the third radiator plate 40. The second radiator plate 30 is coupled to the first radiator plate 20 and the third radiator plate 40.

In at least one embodiment, the baseplate 10 is made of composite materials, such as glass epoxy phenolic, for example. The baseplate 10 is located adjacent to the PCB 220, and includes a first surface 12 and a second surface 14 opposite to the first surface 12. The first radiator plate 20 and the second radiator plate 30 are disposed on the first surface 12, and the third radiator plate 40 is disposed on the second surface 14.

The first radiator plate 20 is substantially an L-shaped sheet, and includes a feed section 22 and an extending section 24. The feed section 22 extends towards the PCB 220 to coupled to the feed pin 222. The extending section 24 is perpendicularly connected to the feed section 22, and extends towards a side of the baseplate 10.

The second radiator plate 30 is substantially a U-shaped sheet, and includes a first coupling section 32, a second coupling section 34, and a third coupling section 36. The first coupling section 32 can be a rectangular sheet, and is spaced from and parallel to the extending section 24. Thus, a slot S is defined between the first coupling section 32 and the extending section 24 to allow the extending section 24 to be electronically coupled to the first coupling section 32. The second coupling section 34 and the third coupling section 36 are symmetrically and perpendicularly connected to two opposite ends of the first coupling section 32.

Figure 2:
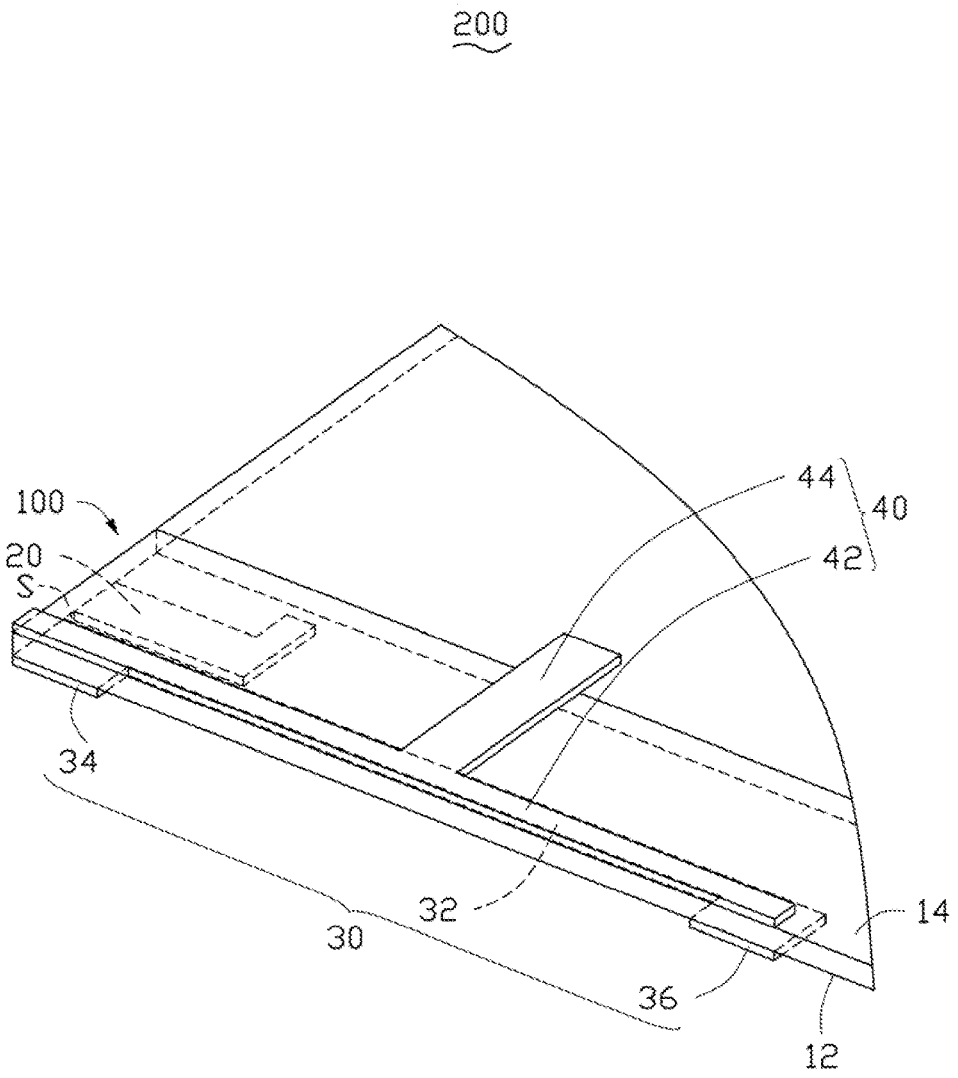
FIG. 2 is similar to FIG. 1, but shown from another angle.
Figure 5:
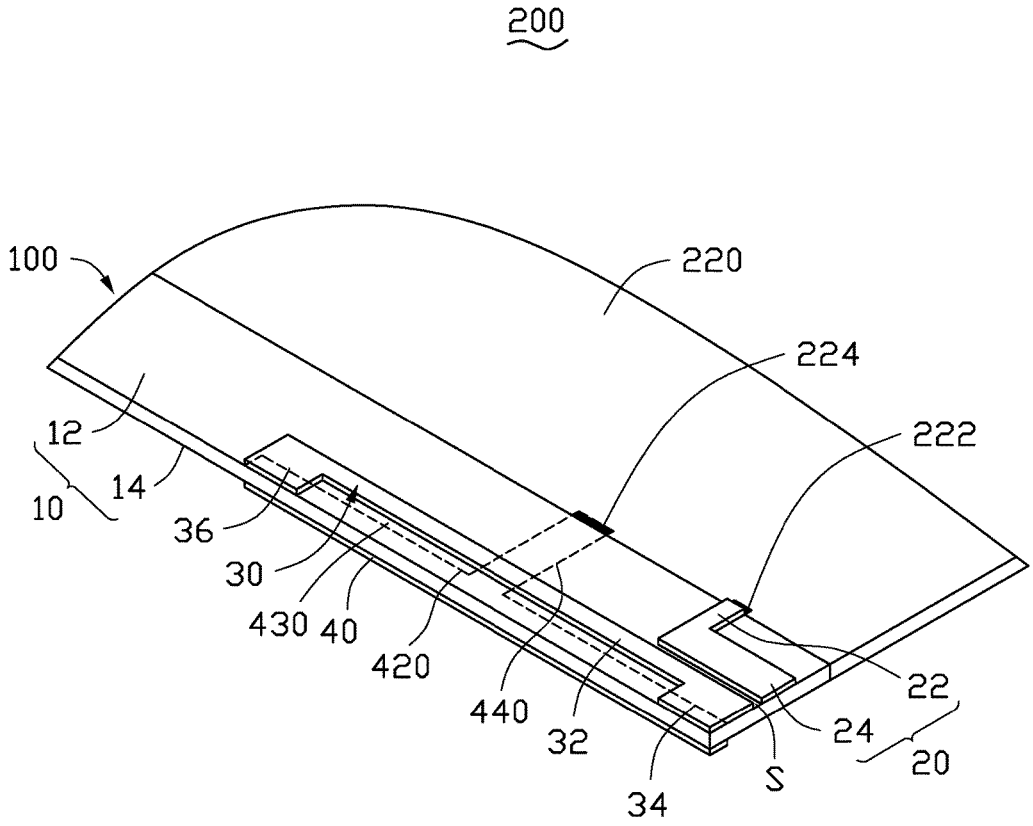
FIG. 5 is an isometric view of the antenna structure of FIG. 1, showing an orthogonal projection of an third radiator plate on a first surface.

Also referring to FIGS. 2 and 5, the third radiator plate 40 is substantially a T-shaped sheet, and includes a connection section 42 and a ground section 44. The connection section 42 can be a rectangular sheet, and is coupled to the first coupling section 32. In at least one embodiment, lengths of the connection section 42 and the first coupling section 32 are the same. An orthogonal projection 420 of the connection section 42 on the first surface 12 and the second radiator plate 30 jointly define a rectangle 430. That is, the orthogonal projection 420 of the connection section 42 on the first surface 12, the second coupling section 34, the first coupling section 32, and the third coupling section 36 are connected in turn. The ground section 44 is perpendicularly connected to a middle portion of the connection section 42, and extends towards the PCB 220 to coupled to the ground pin 224. An orthogonal projection 440 of the ground section 44 on the first surface 12 is perpendicular to the first coupling section 32. Thus, current from the second radiator plate 30 can be coupled to the connection section 42 via the second coupling section 34 and the third coupling section 36, and the current can also be coupled from the first coupling section 32 to the ground section 44.

When current is input to the feed pin 22 from the PCB 200, the current flows to the extending section 24, and then is coupled to the second radiator plate 30 and the third radiator plate 40. The current is grounded by the ground section 44 to form at least three current paths. Specifically, the first radiator plate 20, the second radiator plate 30, and the third radiator plate 40 cooperatively form a first current path for resonating a first mode to receive and transmit wireless signals at a first bandwidth which can be for example about 2400-2484 MHz. In addition, the second radiator plate 30 and the third radiator plate 40 jointly form a second current path for resonating a second mode to receive and transmit wireless signals at a second bandwidth which can be for example about 3410-3590 MHz. Furthermore, the first radiator plate 20 forms a third current path for resonating a third mode to receive and transmit wireless signals at a third bandwidth which can be for example about 5200-6500 MHz.

Figure 3:
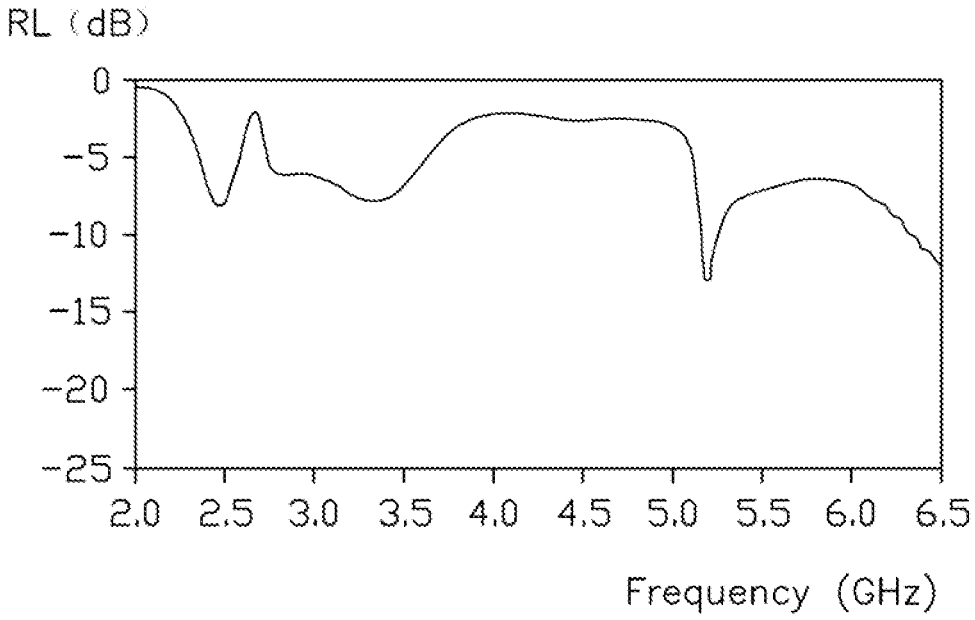
FIG. 3 is a return loss (RL) graph of the antenna structure of FIG. 1.

FIG. 3 illustrates a return loss (RL) graph of the antenna structure 100. The antenna structure 100 has good performance when operating at 2400-2484 MHz, 3410-3590 MHz, and 5200-6500 MHz, for receiving and transmitting wireless signals, such as BLUETOOTH signals, LTE signals, or WIFI signals.

Figure 4:
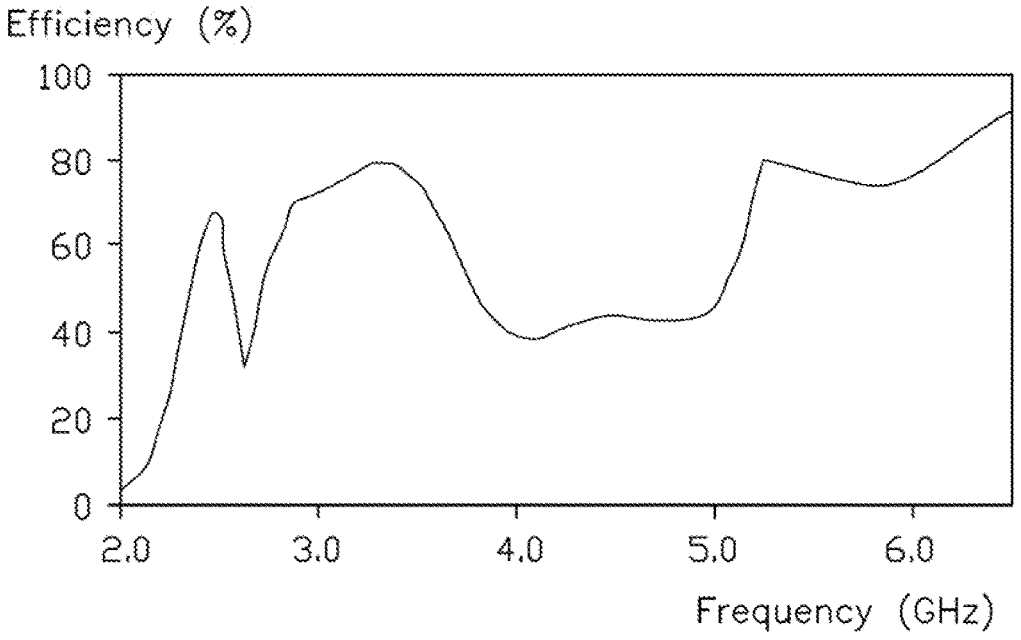
FIG. 4 is an antenna efficiency graph of the antenna structure of FIG. 1.

FIG. 4 illustrates an antenna efficiency of the antenna structure 100. When the antenna structure 100 operates at 2400-2484 MHz, the antenna efficiency can be about 60%-70%. When the antenna structure 100 operates at 3410-3590 MHz, the antenna efficiency can be about 75%-80%. When the antenna structure 100 operates at 5200-6500 MHz, the antenna efficiency can be about 60%-80%.

In summary, the second radiator plate 30 is coupled to the first radiator plate 20 and the third radiator plate 40, and jointly form a closed current circuit with the third radiator plate 40. Thus, the antenna structure 100 has good communication quality at a plurality of frequency bands used in wireless communications, which allows further size reductions of the wireless communication device 200 employing the antenna structure 100.

The embodiments shown and described above are only examples. Many details are often found in the art such as the other features of the antenna structure and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure, comprising:

a baseplate having a first surface and a second surface opposite to the first surface;

a first radiator plate attached to the first surface, the first radiator comprising an extending section;

a second radiator plate attached to the first surface and coplanar with the first radiator plate, the second radiator plate comprising a first coupling section, a second coupling section, and a third coupling section, wherein the first coupling section is parallel to the extending section, the second coupling section and the third coupling section are symmetrically and perpendicularly connected to two opposite ends of the first coupling section; and a third radiator plate attached to the second surface;

wherein a slot is defined between the first radiator plate and the second radiator plate, the second radiator plate is coupled to the first radiator plate and the third radiator plate, and a closed current circuit is jointly defined by the second radiator plate and the third radiator plate.

2. The antenna structure as claimed in claim 1, wherein the first radiator plate comprises a feed section, the feed section is configured for receiving current, the extending section is perpendicularly connected to the feed section, and extends towards a side of the baseplate.

3. The antenna structure as claimed in claim 1, wherein the slot is defined between the first coupling section and the extending section.

4. The antenna structure as claimed in claim 1, wherein the third radiator plate comprises a connection section and a ground section, the connection section is coupled to the first coupling section, and the ground section is perpendicularly connected to a middle portion of the connection section.

5. The antenna structure as claimed in claim 4, wherein an orthogonal projection of the connection section on the first surface and the second radiator plate jointly define a rectangle.

6. The antenna structure as claimed in claim 4, wherein an orthogonal projection of the connection section on the first surface, the second coupling section, the first coupling section, and the third coupling section are connected in turn.

7. The antenna structure as claimed in claim 4, wherein an orthogonal projection of the ground section on the first surface is perpendicular to the first coupling section.

8. A wireless communication device, comprising an antenna structure, the antenna structure comprising:

a baseplate having a first surface and a second surface opposite to the first surface;

a first radiator plate attached to the first surface, the first radiator comprising an extending section;

a second radiator plate attached to the first surface and coplanar with the first radiator plate, the second radiator plate comprising a first coupling section, a second coupling section, and a third coupling section, wherein the first coupling section is parallel to the extending section, the second coupling section and the third coupling section are symmetrically and perpendicularly connected to two opposite ends of the first coupling section; and a third radiator plate attached to the second surface;

wherein a slot is defined between the first radiator plate and the second radiator plate, the second radiator plate is coupled to the first radiator plate and the third radiator plate, and a closed current circuit is jointly defined by the second radiator plate and the third radiator plate.

9. The wireless communication device as claimed in claim 8, wherein the first radiator plate comprises a feed section, the feed section is configured for receiving, the extending section is perpendicularly connected to the feed section, and extends towards a side of the baseplate.

10. The wireless communication device as claimed in claim 8, wherein the slot is defined between the first coupling section and the extending section.

11. The wireless communication device as claimed in claim 8, wherein the third radiator plate comprises a connection section and a ground section, the connection section is coupled to the first coupling section, and the ground section is perpendicularly connected to a middle portion of the connection section.

12. The wireless communication device as claimed in claim 11, wherein an orthogonal projection of the connection section on the first surface and the second radiator plate jointly define a rectangle.

13. The wireless communication device as claimed in claim 11, wherein an orthogonal projection of the connection section on the first surface, the second coupling section, the first coupling section, and the third coupling section are connected in turn.

14. The wireless communication device as claimed in claim 11, wherein an orthogonal projection of the ground section on the first surface is perpendicular to the first coupling section.

15. The wireless communication device as claimed in claim 11, further comprising a printed circuit board (PCB) located adjacent to the baseplate, wherein the PCB forms a feed pin and a ground pin, the first radiator plate is coupled to the feed pin, the third radiator plate is coupled to the ground pin.

* * * * *